US009074835B2

(12) United States Patent
Arnedo Vera et al.

(10) Patent No.: US 9,074,835 B2
(45) Date of Patent: Jul. 7, 2015

(54) SPRING RIFLE WITH ACTUATOR

(75) Inventors: Julian Arnedo Vera, Barcelona (ES); Victor Tresserras Torre, Barcelona (ES)

(73) Assignee: GAMO OUTDOOR, S.L., Barcelona (ES)

( * ) Notice: Subject to any disclaimer, the term of this patent is extended or adjusted under 35 U.S.C. 154(b) by 348 days.

(21) Appl. No.: 13/810,032

(22) PCT Filed: Mar. 31, 2011

(86) PCT No.: PCT/ES2011/070223

§ 371 (c)(1),
(2), (4) Date: May 29, 2013

(87) PCT Pub. No.: WO2012/007617

PCT Pub. Date: Jan. 19, 2012

(65) Prior Publication Data

US 2015/0107567 A1 Apr. 23, 2015

(30) Foreign Application Priority Data

Jul. 15, 2010 (ES) ..... 201031082

(51) Int. Cl.
*F41A 19/00* (2006.01)
*F41A 19/58* (2006.01)
(Continued)

(52) U.S. Cl.
CPC ..... *F41B 7/003* (2013.01); *F41A 19/59* (2013.01); *F41B 11/642* (2013.01); *F41B 11/71* (2013.01); *F41A 17/06* (2013.01); *F41A 19/57* (2013.01); *F41A 19/58* (2013.01); *F41B 11/57* (2013.01)

(58) Field of Classification Search
CPC ..... F41A 19/58; F41A 9/591; F41A 19/10; F41A 17/06; F41A 19/59; F41B 11/57
USPC ..... 124/31, 37, 66; 42/69.01, 70.01, 84; 89/135, 136, 28.05, 28.1
See application file for complete search history.

(56) References Cited

U.S. PATENT DOCUMENTS 2,780,882 A * 2/1957 Temple ..... 42/84
3,427,924 A 2/1969 Johnsen
(Continued)

FOREIGN PATENT DOCUMENTS

BE 702713 2/1968
CH 419 899 8/1966
(Continued)

OTHER PUBLICATIONS

International Search Report of PCT/ES2011/070223 dated Jul. 13, 2011.
(Continued)

*Primary Examiner* — Alvin Hunter
*Assistant Examiner* — Alexander Niconovich
(74) *Attorney, Agent, or Firm* — RatnerPrestia

(57) ABSTRACT

Air rifle comprising a trigger that actuates a firing mechanism that acts on an interconnection piece; that exerts a force on a counter-pawl that releases a spring for driving a piston, in which said firing mechanism is an electronic firing mechanism with an electromechanical actuator and a switch for actuating the electromechanical actuator, the electromechanical actuator being arranged in such a way that it exerts a force on the interconnection piece in a direction substantially parallel to the direction of the barrel of the gun.

20 Claims, 8 Drawing Sheets

(51) Int. Cl.

| | |
|---|---|
| ***F41A 19/59*** | (2006.01) |
| ***F41A 11/00*** | (2006.01) |
| ***F41B 7/00*** | (2006.01) |
| ***F41B 11/642*** | (2013.01) |
| ***F41B 11/71*** | (2013.01) |
| ***F41A 17/06*** | (2006.01) |
| ***F41A 19/57*** | (2006.01) |
| ***F41B 11/57*** | (2013.01) |

(56) References Cited

U.S. PATENT DOCUMENTS

| | | | | |
|---|---|---|---|---|
| 3,650,174 | A | 3/1972 | Nelsen | |
| 3,703,845 | A * | 11/1972 | Griew | 89/134 |
| 3,888,021 | A * | 6/1975 | McCurdy | 434/19 |
| 3,899,845 | A * | 8/1975 | Wild et al. | 42/69.01 |
| 4,009,536 | A | 3/1977 | Wolff | |
| 4,324,060 | A | 4/1982 | Lawrence | |
| 4,329,803 | A * | 5/1982 | Johnson et al. | 42/84 |
| 4,433,610 | A | 2/1984 | Tatro | |
| 4,510,844 | A | 4/1985 | Fritz | |
| 4,718,187 | A * | 1/1988 | Blake | 42/84 |
| 4,727,670 | A * | 3/1988 | Krouse | 42/69.01 |
| 4,793,085 | A * | 12/1988 | Surawski et al. | 42/84 |
| 4,890,405 | A | 1/1990 | Krouse | |
| 4,913,655 | A | 4/1990 | Pinkley | |
| 5,485,776 | A | 1/1996 | Ealovega | |
| 5,623,114 | A * | 4/1997 | Soper | 89/141 |
| 5,713,150 | A | 2/1998 | Ealovega | |
| 5,755,056 | A * | 5/1998 | Danner et al. | 42/84 |
| 5,881,485 | A * | 3/1999 | Milazzo | 42/70.08 |
| 6,286,240 | B1 | 9/2001 | Collins | |
| 6,354,033 | B1 | 3/2002 | Findley | |
| 6,568,381 | B2 * | 5/2003 | Chang | 124/32 |
| 6,651,542 | B2 * | 11/2003 | Danner et al. | 89/28.05 |
| 6,694,963 | B1 * | 2/2004 | Taylor | 124/32 |
| 6,705,036 | B2 * | 3/2004 | Orr | 42/69.01 |
| 6,763,822 | B1 | 7/2004 | Styles | |
| RE38,794 | E * | 9/2005 | Danner | 42/84 |
| 6,951,071 | B1 | 10/2005 | Acosta | |
| 6,990,971 | B1 | 1/2006 | Moritz | |
| 7,073,284 | B2 * | 7/2006 | Monks et al. | 42/69.01 |
| 7,131,366 | B2 * | 11/2006 | Danner et al. | 89/135 |
| 7,188,444 | B2 | 3/2007 | Danner | |
| 8,336,438 | B2 * | 12/2012 | Compton et al. | 89/28.1 |
| 8,807,007 | B2 * | 8/2014 | Alicea | 89/28.1 |
| 8,850,734 | B2 * | 10/2014 | Lupher et al. | 42/70.05 |
| 8,893,607 | B2 * | 11/2014 | Audibert et al. | 89/136 |
| 8,910,621 | B2 * | 12/2014 | Arnedo et al. | 124/32 |

FOREIGN PATENT DOCUMENTS

| | | |
|---|---|---|
| DE | 731655 | 2/1943 |
| DE | 20303327 | 5/2003 |
| EP | 0081130 | 6/1983 |
| EP | 0 655 598 | 6/1999 |

OTHER PUBLICATIONS

Written Opinion of PCT/ES2011/070223 dated Aug. 8, 2011.

WIPO Communication dated Mar. 3, 2011, acknowledging receipt of Applicant's informal comments on the Written Opinion of the International Searching Authority.

Menier, Renan; EPO Examiner; European Search Report for EP 11 80 6336, May 30, 2013.

Entire patent prosecution history of U.S. Appl. No. 13/810,088, filed Mar. 28, 2013, entitled, "Spring-Loaded Rifle," now U.S. Patent No. 8,910,621, issued Dec. 16, 2014.

International Search Report for Application No. PCT/ES2011/070222 dated Jul. 13, 2011.

Chinese Search Report mailed Jan. 21, 2014 in Chinese Application No. 2011800348368.

Chinese Search Report mailed Jan. 21, 2014 in Chinese Application No. 2011800348353.

* cited by examiner

SPRING RIFLE WITH ACTUATOR

CROSS REFERENCE TO RELATED APPLICATIONS

This application is the U.S. National Phase Application of PCT/ES2011/070223, filed Mar. 31, 2011, which claims priority to Spanish Patent Application No. P201031082, filed Jul. 15, 2010, the contents of such applications being incorporated by reference herein.

FIELD OF THE INVENTION

The present invention refers to a spring rifle of the type described by EP 0655598, which is incorporated herein by reference, the firing of which is effected by electronic means in order to improve the performance it provides to the user as will be explained below.

BACKGROUND OF THE INVENTION

Rifles which comprise a spring of the type described by EP 0655598 are spring rifles, which unlike those of the PCP (Pre-Charged Pneumatic) type, do not require an external source of compressed gas in order to fire a pellet or any type of ammunition.

In spring rifles manual compression of air is achieved by means of a spring. Consequently, the action of the trigger (firing) releases a spring which drives a piston. The rapid movement of the piston causes the compression of air in a reservoir. The compressed air contained in the reservoir or caused by the action of the piston is later evacuated through an opening of a smaller diameter than the reservoir, which facilitates the increase in air pressure. Finally, the evacuated compressed air is used to impel a pellet or any other type of ammunition.

Said rifles have rather lower performance in terms of accuracy compared to PCP type rifles. Principally, the difference in performance is due to the necessity of movement of parts in the firing which causes vibrations and recoil. Nevertheless, spring rifles are an important option owing to their low cost and because few additional accessories, such as pre-compressed gas cylinders, among others, are required.

At present, spring rifles possess mechanical firing by means of a ratchet mechanism and counter-ratchet which are uncoupled by the action of the trigger, allowing the passage of air, compressed by the spring, through the barrel.

In order to improve accuracy, it is necessary that the action of the user on the trigger should require the least possible force, as an action of greater force on the trigger causes an undesirable movement in the rifle at the time of firing. Therefore, at present, the coupling between the ratchet mechanism and counter-ratchet is made to have as small a contact area as possible. It is thus guaranteed that the movement required in order to displace the counter-ratchet and therefore fire is small, requiring a force of less magnitude for its operation.

This type of mechanism to reduce the amount of force necessary to activate the firing means that, when the contact surfaces become very small, any force applied externally, for example an impact, even if not effected direct on the trigger, causes the ratchet mechanism and the counter-ratchet to become uncoupled, causing unintentional firing. Therefore the necessity is observed of having the gentlest possible firing in a weapon which passes the safety tests such as for example the so-called drop test. This test consists of freely dropping the weapon in all possible positions of the rifle, this test is passed if the rifle does not fire in any of the positions.

BRIEF DESCRIPTION OF THE INVENTION

According to this invention, in order to use the least possible force and maintain a contact surface between ratchet mechanism and counter-ratchet which guarantees safety, an electronic release can be incorporated. By using a release of this type it is no longer necessary to overcome the force of friction between two surfaces, but the philosophy of operation changes, as only the force necessary to operate a switch is used. By an internal mechanism the ratchet mechanism and counter-ratchet are uncoupled, preferably by the action of a solenoid, although any other electromechanical firing mechanism could be used.

Therefore, it is an objective of the present invention to disclose a rifle with a type of firing which is performed in such a way that the excessive reduction of the contact surfaces between ratchet mechanism and counter-ratchet is not necessary and it guarantees firing by applying the minimum force to the trigger for its operation. Document EP 0081130, which is incorporated herein by reference, makes known a mechanism for the implementation of a solenoid for low-powered pistols.

A problem known to this document is that its application is valid only for pistols and not for rifles, as the placing of the solenoid in a direction perpendicular to the barrel is useful if a low gas pressure is required. In rifles the pressure is much higher and therefore a solenoid to generate said pressure is of such a size that it would impair the aesthetics and ergonomics of the rifle. Therefore, it is an objective of this invention to find a solution for the use of a solenoid situated in the rifle without having to drastically change the shape and ergonomics presented by this type of devices of a conventional shape.

Therefore there is a need to find a way of placing the solenoid in a way that is substantially parallel to the barrel.

To solve this, this invention discloses an electronic firing mechanism by means of an electromechanical actuator, placing the actuator in such a way that it operates in a direction substantially parallel to the barrel. Preferably, said electromechanical actuator is a solenoid.

To effect a firing in a rifle according to this invention, force must be applied in a direction substantially perpendicular to the direction of the barrel, therefore it is relevant that the position of the solenoid is such that it can be adapted to the conventional shape of rifles and is placed in a direction parallel to said barrel. Consequently, mechanical means must be provided which make it possible to change the direction of the force applied by the solenoid which is in a direction parallel to the barrel, hereinafter referred to as the horizontal direction, to a substantially perpendicular force, hereinafter referred to as the vertical direction. In this invention said piece is a piece in the form of a joint which when activated by a horizontal force from the solenoid exerts a vertical force on the counter-ratchet, causing the firing of the rifle.

It should be noted that with the presence of said piece, the size of the contact surface between the ratchet mechanism and counter-ratchet does not matter, as the force to uncouple them is not exerted directly on the counter-ratchet as in the prior art, but it is exerted on the piece which requires a much smaller force.

The spring rifle, according to the present invention, comprises:

a trigger which drives a firing mechanism which operates on an interconnection piece; which exerts a force on a counter-ratchet which releases a spring driving a piston in which said firing mechanism is an electronic firing mechanism which comprises an electromechanical actuator and a switch to operate the electromechanical actuator, the electromechanical actuator being arranged in such a way that it exerts a force on the interconnection piece in a direction substantially parallel to the direction of the rifle barrel.

Said interconnection piece is preferably swivelling and it allows a change of direction of the force generated by the horizontal movement of the electromechanical actuator to a vertical force which uncouples the ratchet mechanism and the counter-ratchet, allowing the operation of the spring and permitting the passage of gas, compressed by the piston, through the barrel. Preferably, said electromechanical actuator comprises a solenoid.

Said interconnection piece can also comprise a first piece fixed to the body of the rifle and a second piece fixed to the counter-ratchet, in such a way that said first and second pieces are joined by a joint. On this joint the electromechanical actuator will subsequently exert the force, making the piece receive a horizontal force and converting it to a force substantially perpendicular to that received.

In another preferred embodiment, the rifle has an auxiliary firing mechanism independent of the electronic firing mechanism. This firing mechanism is important because it must permit the use of the rifle in the event that for any reason the electronic firing mechanism should fail. This use, in addition to discharging the rifle, allows it to continue to be fired at targets with a substantially lower accuracy yet maintaining the same firing system (operation of the trigger). That is to say, said independent auxiliary firing mechanism comprises means for discharging the rifle and for firing with substantially lower performance than that provided by the electronic firing mechanism.

Preferably, the rifle firing mechanism should comprise a trigger locking mechanism, to prevent its movement when the user so wishes, in such a way that accidental firings do not occur, preferably said firing mechanism also comprises a second switch on the current to the solenoid for use as an electrical safety device, so that the solenoid cannot become energised unless this switch is moved to the firing position. Even more preferably, the second switch comprises an activation lever which acts as a locking mechanism for the trigger. Thus both the mechanical and electrical locking of the trigger are achieved by means of a single device.

Also, to operate the switch, but to maintain the sensation of firing, said firing mechanism comprises a flexible rod to operate the switch. Said flexible rod is mechanically coupled to the trigger and the trigger moves the rod until the rod touches the switch.

Preferably the firing mechanism also comprises a plate which prevents the action of the electromechanical actuator on other pieces when the trigger is in the rest position and the said plate also comprises a guide for the flexible rod.

BRIEF DESCRIPTION OF THE DRAWINGS

The invention is best understood from the following detailed description when read in connection with the accompanying drawings.

DETAILED DESCRIPTION OF THE INVENTION

Figure 1:
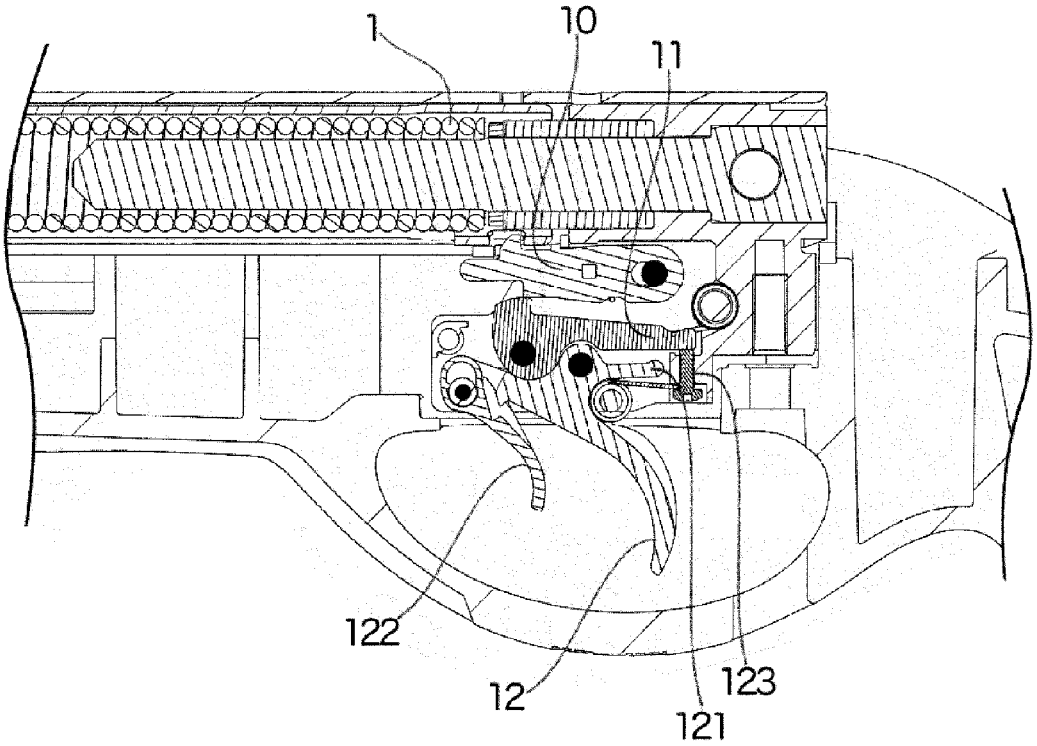
FIG. 1 (PRIOR ART)
FIG. 1 shows the prior art in respect of spring rifles.

FIG. 1 shows a rifle with firing effected exclusively with mechanical means. It has a spring -1- and a piston coupled to the said spring, which is held by means of a ratchet mechanism -10- in the energy storage position. As firing mechanisms there is a counter-ratchet -11- and a trigger -12-. It may be observed that between the ratchet mechanism -10- and the counter-ratchet -11- there is a contact surface, which ideally is the smallest possible, but it must withstand safety tests which guarantee adequate functioning. The smaller the contact surface between the ratchet mechanism -10- and the counter-ratchet -11-, the less is the force necessary to effect the firing (the ideal situation for the user) but safety is also diminished because a fall of the weapon or the action of any force on this may cause firing.

The firing action is effected when the trigger -12- is rotated anti-clockwise. First, there is a free movement of the trigger -12- until the extension -121- comes into contact with the counter-ratchet -11-. At that moment, the firing point has been reached, as any movement from this point causes the uncoupling between the ratchet mechanism -10- and the counter-ratchet -11-, that is to say, firing. Furthermore, the rifle must have a safety system to prevent the trigger -12- being pressed accidentally. This safety is achieved by means of incorporating a safety catch -122- into the trigger. It may be stressed that said safety catch -122- only prevents the trigger -12- being pressed but a fall of the rifle or an unintentional impact may cause the counter-ratchet -11- to move causing uncoupling from the ratchet mechanism -10-. Therefore, the contact surface between both must have a distance which provides safety and which is sufficiently smooth to help the accuracy of the shooter. Furthermore, as each shooter has his preferences with regard to the force required to effect firing, rifles according to the prior art possess a screw -123- which permits the adjustment which defines the contact surface between the ratchet mechanism -10- and the counter-ratchet -11-, and consequently the force required to uncouple them.

Figure 2:
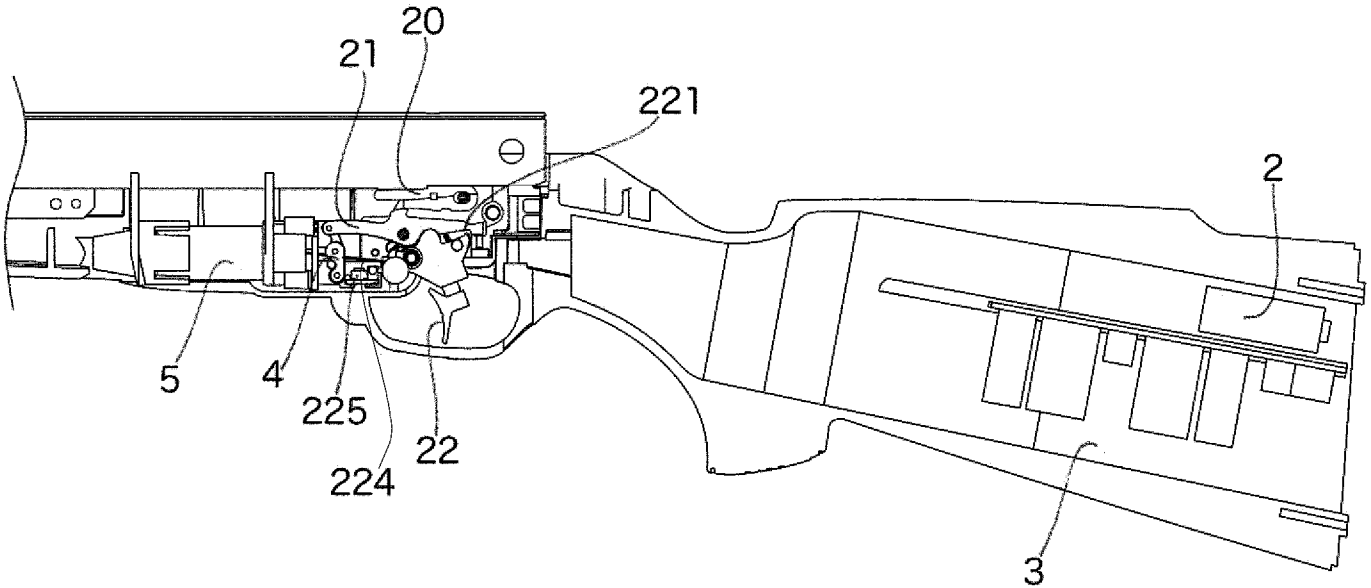
FIG. 2 shows an exemplary embodiment of a rifle according to the present invention.

FIG. 2 shows a rifle according to the present invention. A rifle with electronic firing comprises a battery -2- and a circuit -3- to adapt the energy obtained from the battery and take it to an adequate voltage level to have sufficient mechanical force to displace the counter-ratchet -21- similar to that known in the state of the art. Continuing with the electrical components, the firing of the rifle according to the present invention is performed when a switch -225- is pressed, which permits the passage of electric energy to a solenoid -5- which converts this electric energy to mechanical energy to effect a firing.

In respect of the mechanical components, the present invention comprises a counter-ratchet -21- similar to that known in the state of the art, in so far as it possesses a contact area with a ratchet mechanism -20- which at the moment of firing is intended to be uncoupled to permit the action of a spring (not shown) which performs a compression and release of air causing the firing of a projectile. In order to effect this uncoupling, the force in the horizontal direction effected by the solenoid -5- must be converted into a force in the vertical direction which causes the counter-ratchet -21- to rotate, uncoupling it from the ratchet mechanism -20-. Said conversion of the direction of the force is obtained thanks to a toggle link -4- or swivelling piece, which will be explained subsequently in greater detail. The rifle shown in FIG. 2 also has an auxiliary mechanical firing system, in the event that for any reason the electronic firing mechanism should not operate, there is an auxiliary firing mechanism which is not so accurate nor does it offer the performance of the electronic firing mechanism but even so it permits an acceptable shot which makes it possible, in addition to discharging the weapon, to use it with acceptable accuracy. Said firing mechanism is obtained thanks to the extension -221- which causes the counter-ratchet -21- to rotate in a manner functionally similar to the extension -121- in the prior art, as, once the switch is operated and in the event that this should not function, it is the flexibility of the rod -224- which allows the trigger to continue to rotate, allowing the extension -221- to move the counter-ratchet -21-.

Figure 3:
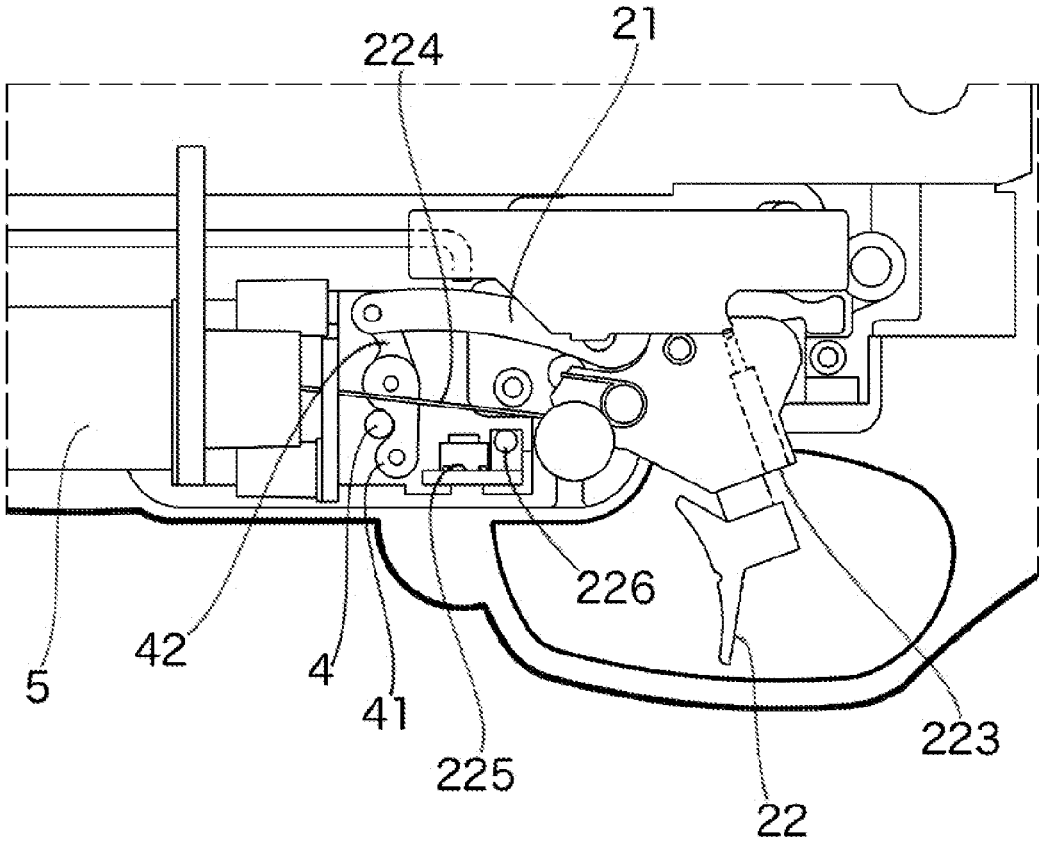
FIG. 3 shows in detail an electronic firing mechanism according to the present invention.

FIG. 3 shows in detail an electronic firing mechanism. Firing is achieved by causing the counter-ratchet -21- to rotate in a similar way to how it is performed in rifles according to the prior art.

Therefore, in the case of the mechanical firing mechanism it was sufficient to have a device which exerted a force in a vertical direction upon one of the ends of the counter-ratchet to perform a firing, in the case of the firing mechanisms according to the present invention a similar event occurs. The problem which presents itself is that the force must have a not inconsiderable magnitude, and to exert this force in a vertical direction a solenoid -5- of a considerable size is used, which if placed vertically would affect the aesthetics and ergonomics of the rifle. Consequently, it is optimal to locate said solenoid -5- in the horizontal direction and to use a piece which makes it possible to transform the horizontal direction of the force exerted by the solenoid into a force in a vertical direction which allows the counter-ratchet to be rotated.

In the present invention said change in the direction of the force is effected through a swivelling piece or toggle link -4-. Said toggle link -4- comprises a first part -41- which is secured to a fixed part of the rifle, as body is, and a second piece -42- which is secured to the counter-ratchet and it possesses a joint between the pieces in such a way that it is possible to execute a horizontal movement when exerting a force on the joint. The functioning of the toggle link is such that when it receives a horizontal movement in the joint between both pieces, as the first piece -41- is secured to a fixed point in the rifle a force is exerted by the second piece -42- in a vertical direction on the counter-ratchet, causing it to rotate and consequently firing the rifle.

The firing mechanism also comprises a trigger -22- with an adjustable position to be set by the shooter, a screw -223- for the adjustment of the force required to move the trigger -22- a switch -225- the function of which is to close the circuit which delivers energy to the solenoid -5- activating it and a light emitting diode LED -226- which serves to indicate the state of operation of the electronic firing mechanism. In order to execute a firing it is sufficient to press the switch -225-. Furthermore the need to have a similar feel to that of rifles with a conventional firing mechanism is an important point to increase the accuracy which a user may have, therefore, the switch -225- is operated through a mechanism which we shall call the "flexible rod". This mechanism is based on the use of a rod -224- which at rest has a substantially straight geometry, the trigger is moved until said rod reaches a stop (which may be the switch itself) which simulates the point at which the shooter knows that he is close to activating the spring. Once there, the rod starts to take a substantially more curved geometry until it presses the switch -225-.

Figure 4:
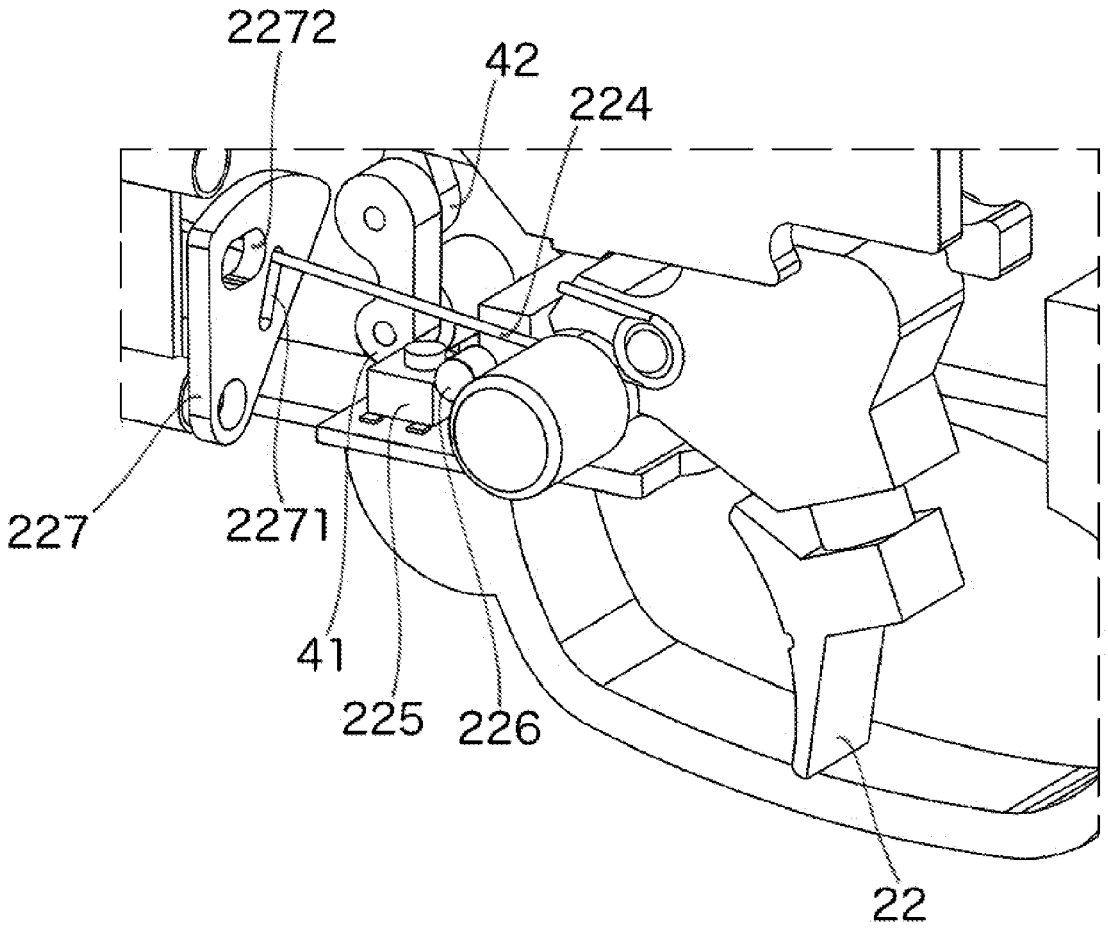
FIG. 4 shows a rifle according to the present invention with the trigger in the rest position.
Figure 5:
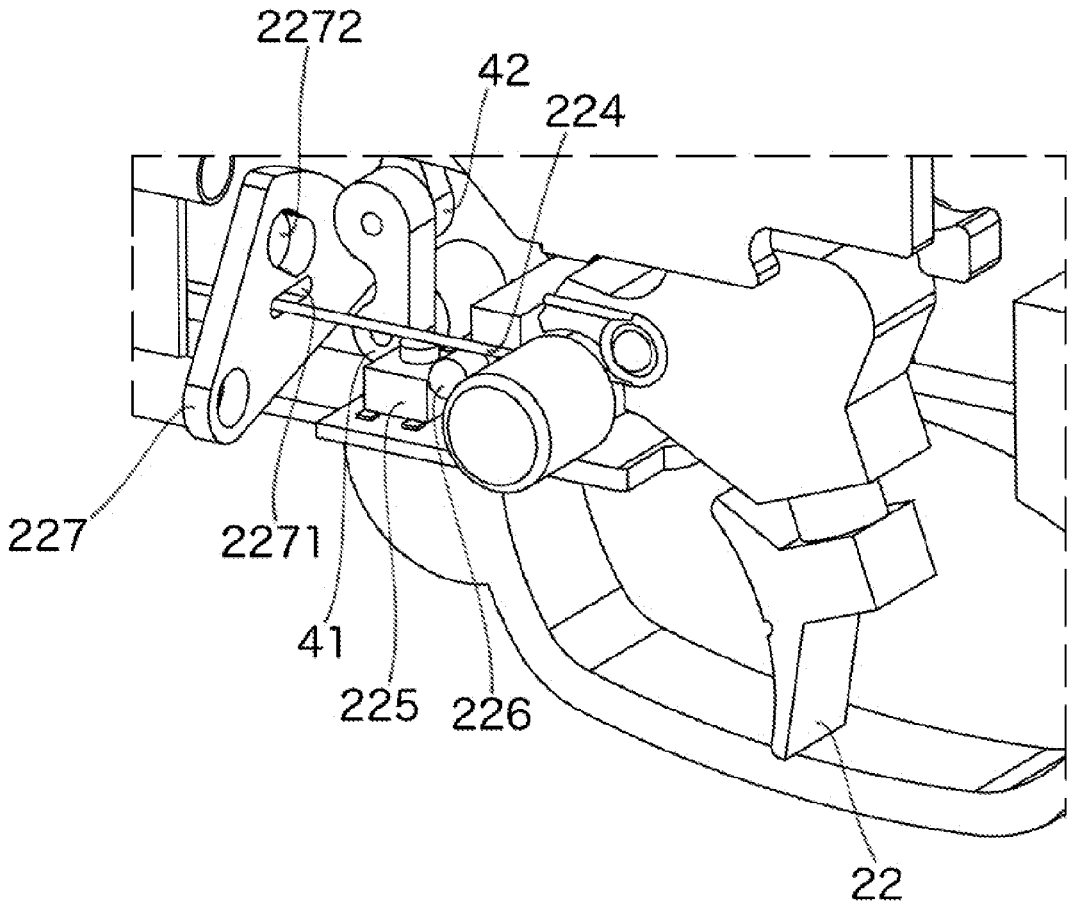
FIG. 5 shows a rifle according to the present invention with the trigger at the firing point.

FIGS. 4, 5 and show the operation of the firing mechanism in three different positions of the trigger.

FIG. 4 shows the firing mechanism when the trigger is in the passive position (without action on the part of the user). It may be noted that the rod -224- is in its initial position, separated from the switch, -225-. In order to provide greater protection and have a guide for the rod -224- using a single device, the rifle according to the present invention has a plate -227- which functions, in addition to being a guide for the rod -224-, as a barrier to prevent the solenoid (not shown) from activating, the toggle link -41-, -42 without the switch having been pressed (for example, owing to a fall, impact etc.). Said strip comprises a guide -2271- to keep the rod on a particular route and a hole -2272- which allows the passage of the actuator of the solenoid when the rod -224- is in an appropriate position for firing (indicating that the trigger -22- has been operated).

FIG. 5 shows the rod -224- when it is in the firing position, it may be observed that the rod -224- has already butted up against the switch -225- giving the user a warning by easing the necessary resistance to cause the trigger -22- to rotate, thus the user knows at what precise moment he is about to fire.

Figure 6:
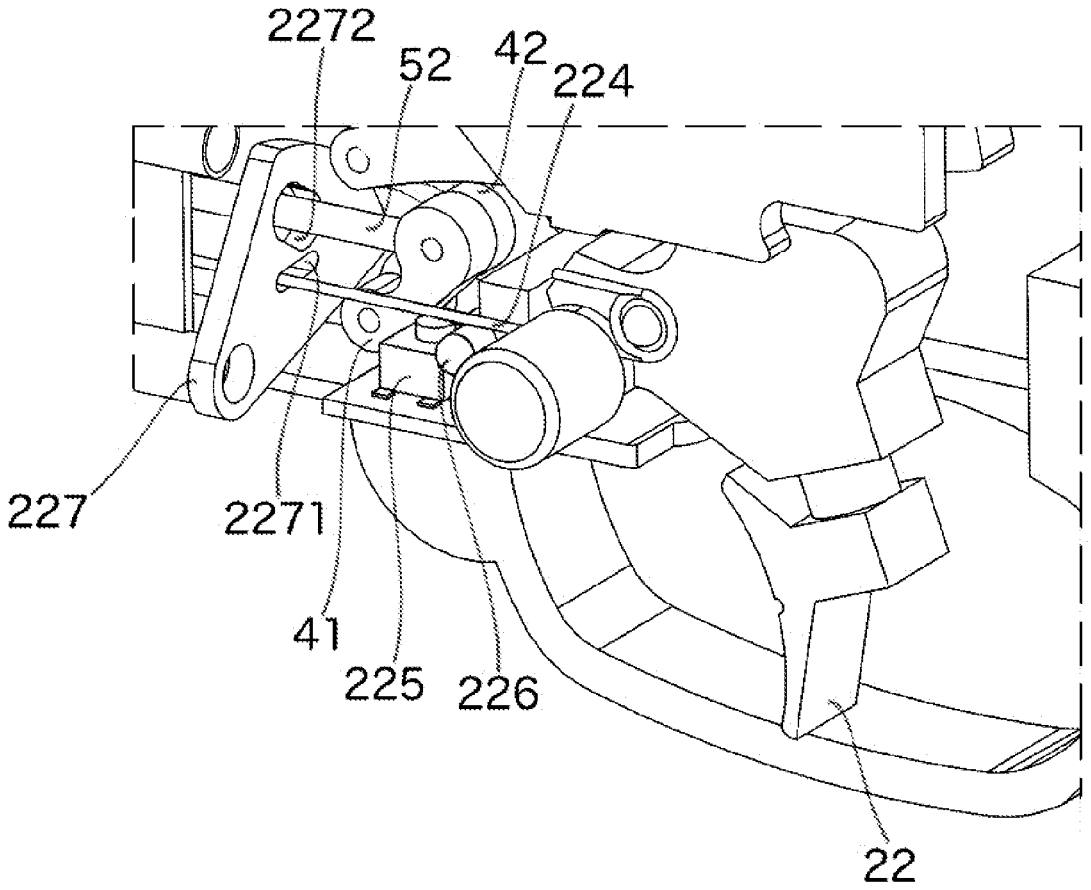
FIG. 6 shows a rifle according to the present invention with the trigger in the final position.

FIG. 6 shows the rod -224- when it activates the switch -225- effecting the firing of the rifle, in addition it is observed how through the plate -227- the solenoid actuator passes through the hole -2272- activating the toggle link -41-, -42-.

Figure 7:
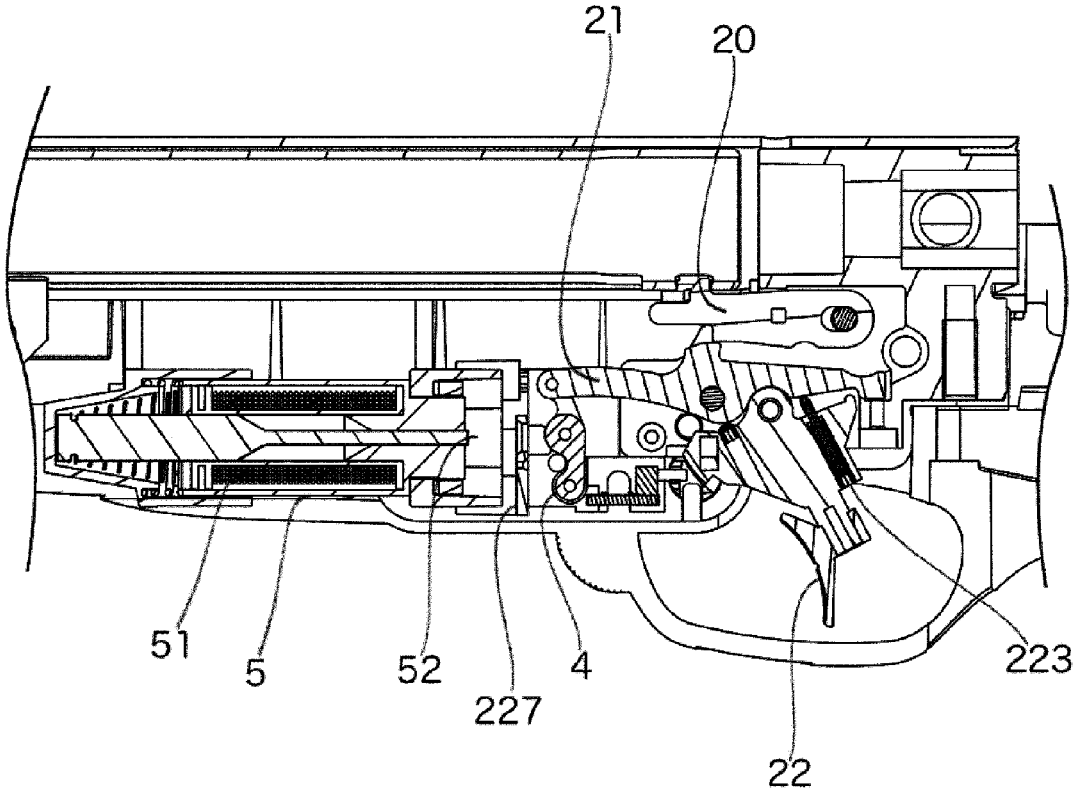
FIG. 7 shows the solenoid of a rifle according to the present invention in the rest position.
Figure 8:
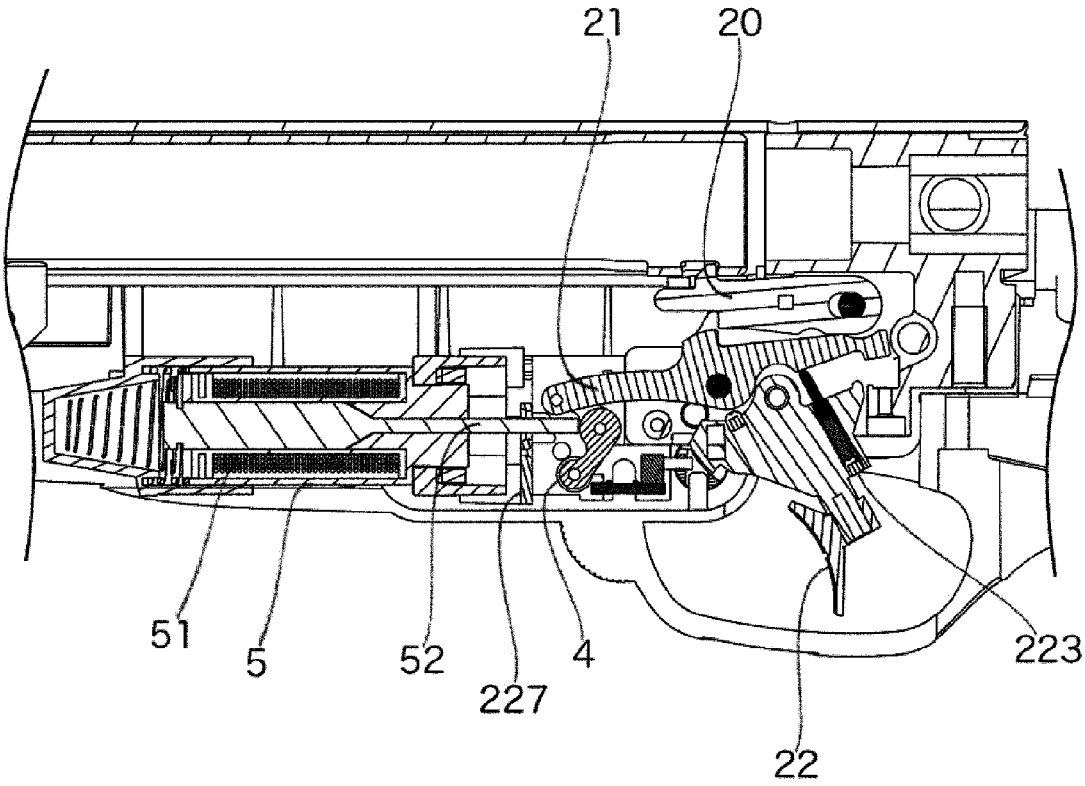
FIG. 8 shows the solenoid of a rifle according to the present invention in the final position.

FIGS. 7 and 8 shove a schematic view to illustrate in detail the operation of the firing mechanism. FIG. 7 shows the rifle in the rest position (without any action on the part of the user) and FIG. 8 shows the rifle in the active position (at the time of firing).

FIG. 7 shows the toggle link -4- in its rest position, that is to say, without exerting force in a vertical direction on the counter-ratchet -21-. In addition one may observe the solenoid -5-, with its respective actuator -52- and its spring -51- in the passive position, that is, without receiving electric energy.

FIG. 8 shows, when the trigger -22- is pressed to the final position, the switch (not shown) which supplies electric energy to the solenoid -5- is activated causing, by means of its coil -51-, an electromechanical force to be exerted in a horizontal direction on the actuator -52-, causing this to pass through a plate until it takes the toggle link -4- to an active position. At this moment the toggle link exerts a force in a vertical direction which causes the counter-ratchet -21- to rotate, uncoupling it from the ratchet mechanism -20- and consequently releasing the spring which causes the firing.

In a particular embodiment, the rifle according to the present invention comprises an electromagnetic safety mechanism which prevents the movement of the trigger and opens the circuit of the switch, making the action, both electrical and mechanical, of the rifle impossible.

Although the invention has been described with respect to examples of preferred embodiments, these must not be considered to be limiting of the invention, which will be defined by the following claims.

The invention claimed is:

1. A spring-loaded rifle having a rifle body, the rifle comprising:

a trigger;

an electronic firing mechanism comprising an electromechanical actuator operable by a first switch;

an interconnection piece having a first part and a second part joined by an articulated joint, the first part fixed to the rifle body;

a counter-ratchet connected to the second part of the interconnection piece; and a spring configured to drive a piston, the piston having a spring-loaded configuration held in place by the counter-ratchet;

the trigger configured to activate the electronic firing mechanism, causing the electronic firing mechanism to act upon the interconnection piece, causing the interconnection piece to exert a force upon the counter-ratchet, which force causes the counter-ratchet to release the piston from the spring-loaded configuration, and the electromechanical actuator arranged to exert a force on the interconnection piece in a direction substantially parallel to the direction of the rifle barrel.

2. The spring-loaded rifle of claim 1, in which said electromechanical actuator comprises a solenoid.

3. The spring-loaded rifle of claim 1, wherein said interconnection piece comprises a swiveling piece configured to convert the force exerted by the electromechanical actuator parallel to the rifle body into a force exerted by the interconnection piece on the counter-ratchet in a direction other than parallel to the rifle body.

4. The spring-loaded rifle of claim 3, wherein the electromechanical actuator is configured to contact the interconnection piece at the articulated joint.

5. The spring-loaded rifle of claim 1, further comprising an auxiliary firing mechanism independent of the electronic firing mechanism.

6. The spring-loaded rifle of claim 5, wherein said independent auxiliary firing mechanism is configured to require greater trigger travel for activation than a degree of trigger travel required for activating the electronic firing mechanism.

7. The spring-loaded rifle of claim 1, wherein the said electronic firing mechanism also comprises a trigger locking mechanism.

8. The spring-loaded rifle of claim 1, wherein said electronic firing mechanism also comprises a second current switch connected to the electromechanical actuator for use as a safety device.

9. The spring-loaded rifle of claim 8, wherein the second current switch comprises an activation lever which acts as a trigger locking mechanism.

10. The spring-loaded rifle of claim 1, wherein said firing mechanism comprises a flexible rod configured to operate the switch.

11. The spring-loaded rifle of claim 10, wherein the flexible rod is mechanically coupled to the trigger and the trigger is configured to move the rod until the rod contacts the switch.

12. The spring-loaded rifle of claim 11, wherein the rod is sufficiently bendable to allow rotation of the trigger to continue after the rod contacts the switch.

13. The spring-loaded rifle of claim 12, further comprising an auxiliary mechanical firing mechanism activated after the rod contacts the switch.

14. The spring-loaded rifle of claim 1, further comprising a plate which prevents the action of the electromechanical actuator on other pieces when the trigger is in a resting position.

15. The spring-loaded rifle of claim 14, further comprising a flexible rod attached to the trigger and configured to operate the switch, wherein said plate also comprises a guide for the flexible rod.

16. The rifle of claim 15, wherein the plate is movable between a first plate position corresponding to the trigger resting position in which the plate is a barrier to the electromechanical actuator contacting the interconnection piece and a second plate position corresponding to a trigger firing position in which the electromechanical actuator is aligned with an aperture in the plate that permits the actuator to pass through the plate to contact the interconnection piece.

17. The rifle of claim 16, wherein the plate further comprises a guide for the flexible rod, the guide configured such that movement of the rod between a first rod position corresponding to the trigger resting position and a second rod position corresponding to the trigger firing position causes the plate to move between the first plate position and second plate position.

18. The rifle of claim 17, wherein the guide comprises a slot in the plate through which the flexible rod passes, and the plate is pivotable between the first plate position and the second plate position.

19. The rifle of claim 1, wherein the flexible rod has a proximal end connected to the trigger, a distal end, and an switch contact portion between the proximal end and distal end positioned to contact the switch.

20. The rifle of claim 1, wherein the switch has an activation resistance force and the rod has a first geometry in which it makes initial contact with the switch and a second geometry, more curved than the first geometry, in which a force exerted by the rod on the switch overcomes an activation resistance force of the switch.

* * * * *